US005845578A

United States Patent [19]

Fogle, Jr.

[11] Patent Number: 5,845,578

[45] Date of Patent: Dec. 8, 1998

[54] IGNITION ELEMENT

[75] Inventor: Homer W. Fogle, Jr., Mesa, Ariz.

[73] Assignee: TRW Inc., Lyndhurst, Ohio

[21] Appl. No.: 796,434

[22] Filed: Feb. 10, 1997

[51] Int. Cl.[6] ..... F42C 19/12

[52] U.S. Cl. ..... 102/202.5

[58] Field of Search ..... 102/202.1, 202.2, 102/202.5, 202.7, 202.8, 202.9

[56] References Cited

U.S. PATENT DOCUMENTS

| | | | |
|---|---|---|---|
| 3,211,096 | 10/1965 | Forney et al. . | |
| 3,362,158 | 1/1968 | Thurston et al. . | |
| 3,434,426 | 3/1969 | De Dapper | 102/202.8 |
| 3,589,294 | 6/1971 | Stresau | 102/202.8 |
| 3,977,328 | 8/1976 | Brown et al. | 102/202.8 |
| 4,070,970 | 1/1978 | Scamaton | 102/202.8 |
| 4,206,705 | 6/1980 | Iqbal et al. | 102/202.5 |
| 4,304,184 | 12/1981 | Jones | 102/202.13 |
| 4,409,898 | 10/1983 | Blix et al. . | |
| 4,458,637 | 7/1984 | Minegishi et al. | 123/145 A |
| 5,085,146 | 2/1992 | Baginski . | |
| 5,146,104 | 9/1992 | Schumacher et al. . | |
| 5,285,727 | 2/1994 | Reams, Jr. et al. . | |
| 5,367,956 | 11/1994 | Fogle, Jr. . | |
| 5,385,097 | 1/1995 | Hruska et al. . | |
| 5,403,036 | 4/1995 | Zakula et al. . | |
| 5,463,954 | 11/1995 | Blair | 102/202 |

OTHER PUBLICATIONS

Definition for "dielectric heating"; Van Nostrand's Scientific Encyclopedia, Sixth Edition; p. 900, 1983.

IEEE Standard Dictionary of Electrical and Electronics Terms, p. 245, 1984.

Hackh's Chemical Dictionary, p. 211, 1974.

The Condensed Chemical Dictionary, Ninth Ed., Van Nostrand and Reinhold Co., pp. 284–285, 1979.

*Primary Examiner*—Charles Jordan
*Assistant Examiner*—Christopher K. Montgomery
*Attorney, Agent, or Firm*—Tarolli, Sundheim, Covell, Tummino & Szabo

[57] ABSTRACT

An ignition element (106) for heating temperature sensitive ignitable material (86) in an air bag inflator comprises an electrically conductive first material layer (142). An electrically conductive second material layer (144) has a portion (146) spaced from and overlying a portion (148) of the first material layer (142). A lossy dielectric material (180) is disposed between the overlying portions (146, 148) of the first and second material layers (142, 144). A high frequency alternating electric field is applied to the first and second material layers (142, 144). The temperature sensitive material (86) is located adjacent the ignition element (106). The temperature of the dielectric material (180) increases to a temperature sufficient to cause ignition of the temperature sensitive material (86) in response to the application of the high frequency alternating electric field to the dielectric material.

24 Claims, 2 Drawing Sheets

IGNITION ELEMENT

BACKGROUND OF THE INVENTION

1. Technical Field

The present invention relates to an ignition element for heating and igniting material. In particular, the ignition element may be used in an inflator for inflating an inflatable vehicle occupant protection device to effect the flow of inflation fluid from the inflator.

2. Description of the Prior Art

Inflators for inflating inflatable vehicle occupant protection devices, such as air bags, are known. One known inflator includes a container, an ignitable gas generating material in the container and an igniter supported by the container. The igniter is located adjacent the gas generating material.

The igniter includes a housing, ignition material in the housing, a resistance wire in contact with the ignition material, and an output charge in the housing which is located adjacent to the ignition material. When electrical current is applied to the resistance wire, it heats and causes the ignition material to ignite. The burning ignition material ignites the output charge. The output charge produces combustion products, including heat, pressure, gas and hot particles, which typically destroy at least a portion of the housing. The combustion products contact and ignite the gas generating material in the container. Burning of the gas generating material produces gas for inflating the air bag.

Another known inflator includes a container for storing gas under pressure. An initiator is supported by the container and includes ignitable pyrotechnic material and an electrically actuatable igniter. The pyrotechnic material is typically sealed from the gas stored in the container. The pyrotechnic material ignites in response to electrical actuation of the igniter. Combustion products produced by ignition of the pyrotechnic material are directed into the gas stored in the container. The gas in the container is heated and the pressure in the container increases. When gas inside the container reaches a predetermined pressure, a portion of the container ruptures and the gas is released from the container to inflate the air bag.

It has been suggested in U.S. Pat. No. 5,146,104 that a capacitor could be connected in series with an initiator to prevent unintentional firing of the initiator by direct current. The capacitor is an additional circuit component that must be located either within or close to the initiator. Electrical connections are required to connect the capacitor with the initiator and other circuit components.

SUMMARY OF THE INVENTION

The present invention is directed to an apparatus which includes an initiator disposed adjacent to a body of pyrotechnic material. The initiator includes a body of dielectric material. A circuit is provided to apply a high frequency alternating electric field to the body of dielectric material. Dissipation of electrical energy in the body of dielectric material results in heating of the dielectric material to a temperature sufficient to ignite the body of pyrotechnic material.

Although the apparatus of the present invention may be used for many different purposes, it is contemplated that the apparatus may be used to effect a flow of inflation fluid from an inflator to inflate a vehicle occupant protection device.

BRIEF DESCRIPTION OF THE DRAWINGS

The foregoing and other features and advantages of the present invention will become apparent to those skilled in the art to which the present invention relates from reading the following specification with reference to the accompanying drawings, wherein.

DESCRIPTION OF A PREFERRED EMBODIMENT

Figure 1:
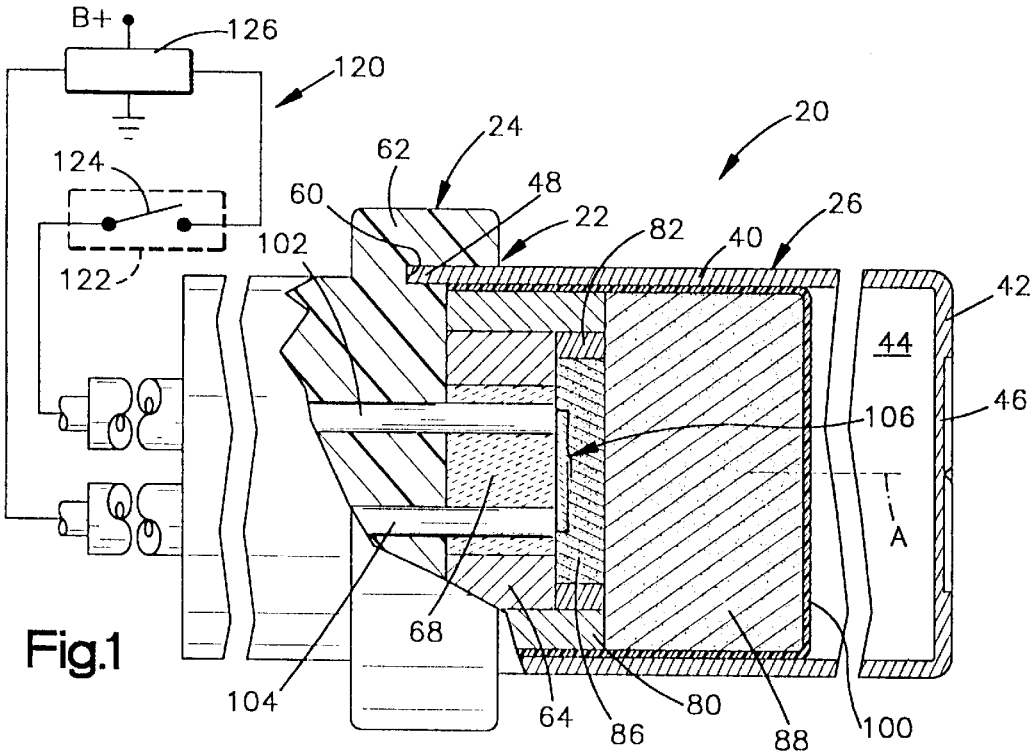
FIG. 1 is a schematic sectional view of an initiator assembly and actuation circuit constructed in accordance with the present invention.

An inflatable vehicle occupant protection system includes an inflatable vehicle occupant protection device, such as an air bag (not shown), and an inflator (not shown). The air bag and the inflator are mounted to a vehicle part, such as a seat, door, instrument panel or steering wheel. Upon actuation, inflation fluid is directed from the inflator to inflate the air bag.

The inflator is electrically actuated in response to a vehicle condition being detected for which inflation of the air bag is desired. The vehicle condition could be a collision of the vehicle during which the vehicle experiences a sudden deceleration above a predetermined deceleration. During inflation, the air bag moves into a position between the vehicle part and an occupant of the vehicle. The inflated air bag helps protect the occupant from forcibly striking or being struck by the vehicle part.

The inflator includes a container for material that is used to effect inflation of the air bag. By way of example, the material is preferably an inert gas stored in a chamber of the container under pressure. The inert gas flows from the inflator to inflate the air bag. It will be apparent that the material could be an ignitable solid gas generant located in the container. Upon ignition, the gas generant produces gas to inflate the air bag. It will also be apparent that the material could be a mixture of gases which is stored in the chamber under pressure and which comprises a combustible fuel gas and an inert gas. The combustible fuel gas, upon ignition, heats the inert gas.

An actuatable initiator assembly 20 (FIG. 1), which embodies the present invention, is used with the inflator to effect the flow of the inert gas from the inflator. The container that is included in the inflator supports the initiator assembly 20. A portion of the initiator assembly 20 may be located in the chamber of the container or the entire initiator assembly may be located outside the chamber near a closure for the container.

The initiator assembly 20 is electrically actuated in response to the vehicle condition being detected for which inflation of the air bag is desired. Upon actuation, the initiator assembly 20 produces initiating combustion products. The initiating combustion products ignite a pyrotechnic material to produce combustion products. The combustion products are directed into the inert gas stored in the chamber of the inflator to heat the inert gas. The pressure of the inert gas increases to a predetermined pressure at which a closure for the chamber ruptures. The initiating combustion products produced by the initiator assembly 20 may also be used to ignite solid gas generant or to ignite a combustible fuel gas.

The initiator assembly 20 includes a housing 22. The housing 22 includes a base 24 which is preferably molded from an electrically insulating plastic material, such as nylon. The housing 22 also includes a tubular container 26 which is made from a suitable material, such as metal or plastic. The container 26 is illustrated as drawn metal with a side wall 40 and a closed end wall 42, to the right as viewed in FIG. 1, which define the chamber 44.

A rupturable weakened area 46 is formed in the closed end wall 42. The side wall 40 and end wall 42 of the container 26 are relatively thick and have sufficient strength to withstand pressure in the chamber 44 of the container. Preferably, only the weakened area 46 ruptures to direct initiating combustion products from the container 26 of the housing 22 in a direction to the right, as viewed in FIG. 1. The weakened area 46 is located coaxially along a longitudinal center axis A of the container 26. The container 26 has an open end portion 48, to the left as viewed in FIG. 1, opposite the closed end wall 42. The open end portion 48 is located in a groove 60 (FIG. 2) in a mounting portion 62 of the base 24 to attach the container to the base.

A header ring 64 (FIGS. 1 and 2) is located in the chamber 44 and is attached to an end surface 66 (FIG. 2) of the base 24. The header ring 64 comprises a cylindrical stainless steel sleeve which encompasses a glass insulation material 68. A metal outer ring 80 is attached to the header ring 64 and the end surface 66 if the base 24. The outer ring 80 engages the outer circumferential surface of the header ring 64 and is welded to the header ring 64 around the perimeter of the header ring.

An ignition charge holder 82 is attached to an end surface 84 of the ring 64 and to a radially inner circumferential surface of the outer ring 80. The ignition charge holder 62 contains an ignition charge 86. Adjacent the ignition charge 86 and the ignition charge holder 62 in the chamber 44 is an output charge 88.

The ignition charge 86 is an ignitable pyrotechnic material that is temperature sensitive. The ignition charge 86 ignites when at least a portion of the ignition charge is heated locally to a predetermined temperature. Any suitable material for the ignition charge 86 may be used, such as zirconium potassium perchlorate ($ZrKClO_4$), barium styphnate monohydrate ($C_6HN_3O_8Ba—H_2O$), cesium hydroborate salt and potassium nitrate ($CS_2B_{12}H_{12}$ —$KNO_3$), or potassium dinitrobenzofuroxane ($C_6H_4N_4O_6K$). The ignition charge 86 burns rapidly to ignite the output charge 88.

Figure 2:
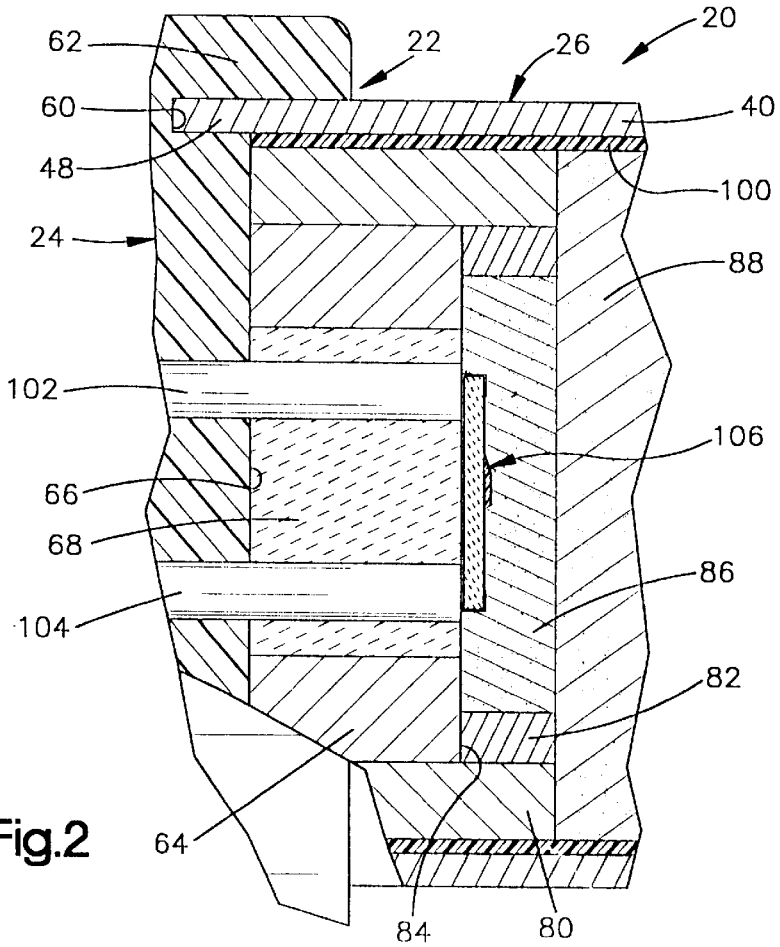
FIG. 2 is an enlarged sectional view of a portion of the initiator assembly of FIG. 1.

The output charge 88 preferably occupies only a portion of the chamber 44 of the container 26, leaving free a volume in the chamber as illustrated in FIG. 1. The output charge 88 is positioned at one end of the container 26 against the ignition charge 86. The free volume occupies the space between the output charge 88 and the end wall 42 of the container 26.

The output charge 88 can occupy a greater or lesser portion of the chamber 44 of the container 26 than shown in FIG. 1. The output charge 88 can occupy the entire volume of the chamber 44 of the container 26. Preferably, the output charge 88 occupies from about 25% to about 100% of the volume of the chamber 44 of the container 26. The chamber 44 of the container 26 thus has a free volume in the range of about 0 to about 75% of the volume of the chamber.

The amount of the output charge 88 is that amount required to produce a sufficient quantity of combustion products to heat the inert gas in the inflator to the predetermined pressure. This amount can vary depending upon the size of the inflator and the volume of the inert gas stored in the container. The output charge 88 can be any solid, particulate, pyrotechnic material having a rapid burn rate and short burn time. One suitable output charge material is a flammable metal-based composition which contains an oxidant.

A preferred material for the output charge 88 is boron potassium nitrate ($BKNO_3$). This material contains about 20–26% by weight boron, about 69–73% by weight potassium nitrate, and about 1.6–6% by weight binder. Other suitable materials for the output charge 88 are aluminum potassium perchlorate, titanium potassium perchlorate, a blend of magnesium and Teflon®, a blend of Teflon and Viton®, and a blend of boron potassium nitrate and titanium potassium perchlorate.

The output charge 88 is preferably held in place by a cup-shaped retainer 100. Alternatively, the output charge 88 can be loose within the chamber 44 of the container 26. If the output charge 88 is loose within the chamber 44 of the container 26 and occupies only a portion of the volume of the chamber, it is still in contact with the ignition charge 86 and readily ignited by burning of the ignition charge.

The retainer 100 also serves as a relatively thin wall insulating envelope that encompasses the output charge 88. The retainer 100 prevents electrical energy and heat from being conducted to the output charge 88. The retainer 100 maintains the shape of the output charge 88 and inhibits moisture from entering the output charge. The retainer 100 can be any suitable insulating material.

A pair of wire conductor leads 102, 104 extend through the base 24 and the glass insulation material 68. The wire conductor leads 102, 104 have ends located within the chamber 44. The wire conductor leads 102, 104 are connected to an electrical actuation circuit 120 (FIG. 1). The wire conductor leads 102, 104 are also connected to an electrically actuatable ignition element 106 (FIGS. 1 and 2) which contacts the ignition charge 86. The ignition element 106 is surrounded by the ignition charge 86 on all but a side of the ignition element which engages the wire conductor leads 102, 104.

The electrical activation circuit 120 (FIG. 1) includes a sensor 122 which has a normally open switch 124. The electrical actuation circuit 120 also includes a power source 126. The power source 126 preferably includes an oscillator which is electrically connected with a battery of the vehicle. Upon the occurrence of a collision or other sudden vehicle deceleration which is at least equal to a predetermined deceleration, the sensor 122 closes the switch 124. The power source 126 delivers a high frequency sinusoidal electric field of alternating polarity to the initiator assembly 20.

The energy in the high frequency alternating polarity electric field from the power source 126 is conducted through the wire conductor leads 102, 104 and to the ignition element 106. The high frequency alternating electric field causes heating of a lossy dielectric material 180 in the ignition element 106 due to dissipation of part of the electrical energy as heat. Thus, the high frequency alternating polarity electric field causes electrons and proton-containing atomic nuclei to shift positions in the dielectric material 180. Molecular friction results in the dissipation of electrical energy as heat. The heat generated by the dissipation of electrical energy increases the temperature of the ignition element 106. Heat transmitted from the ignition element 106 to the ignition charge 86 rapidly heats at least a portion of the ignition charge to ignite the ignition charge.

Figure 3:
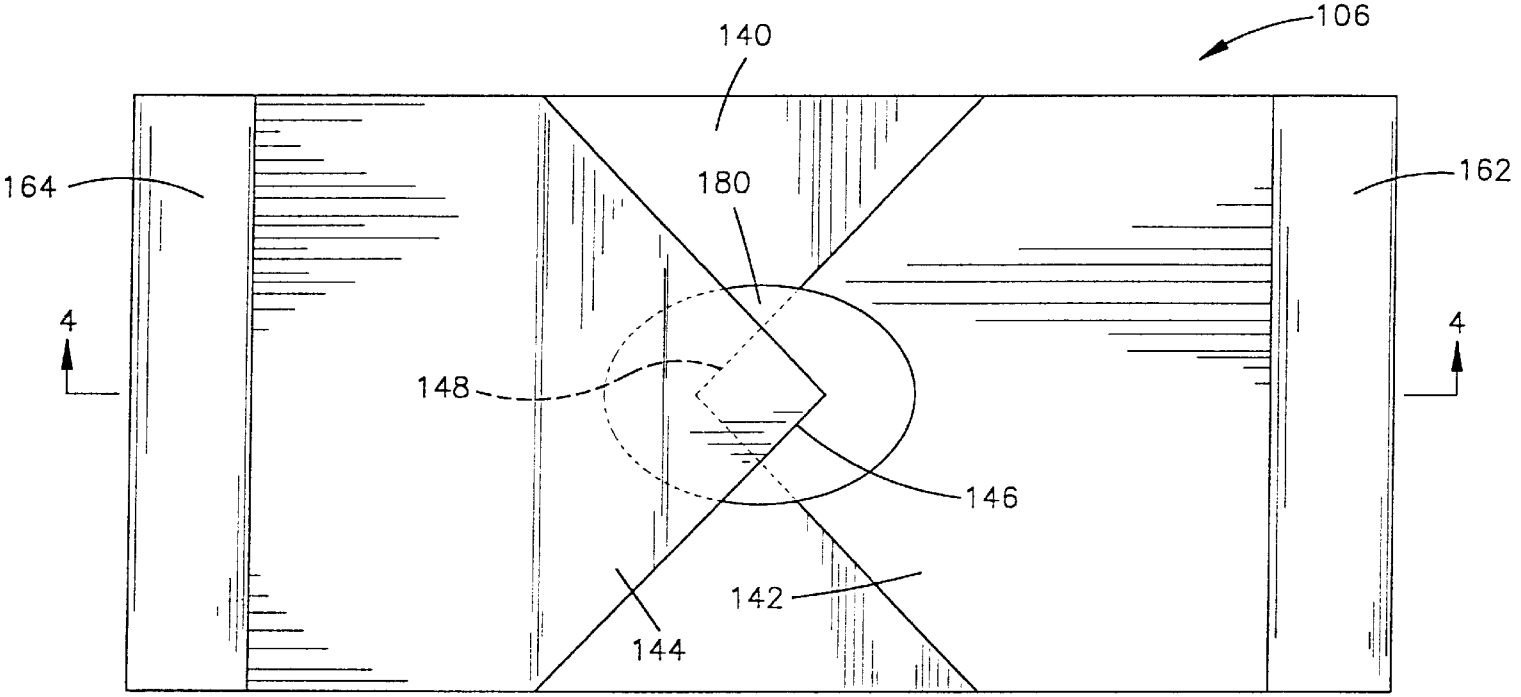
FIG. 3 is an enlarged plan view of an ignition element of the initiator assembly of FIG. 2.
Figure 4:
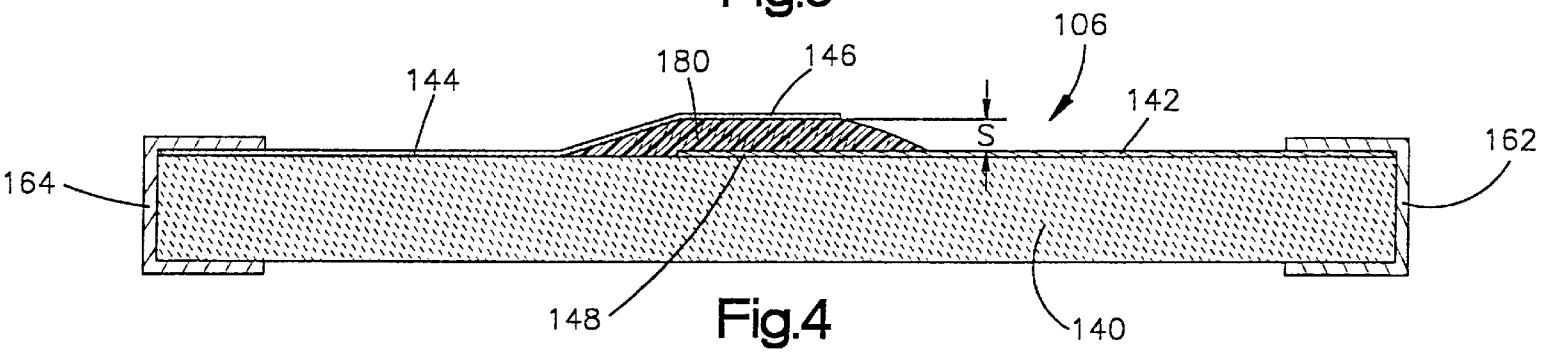
FIG. 4 is an enlarged sectional view of the ignition element of FIG. 3, taken approximately along line 4—4 in FIG. 3.

The ignition element 106 engages the ends of the wire conductor leads 102, 104 and bridges the distance between the wire conductor leads. The ignition element 106 (FIGS. 2–4) includes an electrically insulating support member or substrate 140 (FIGS. 3 and 4). The support member 140 is preferably made from a fired ceramic material, such as dense 96% alumina ($Al_2O_3$), beryllia (BeO) or steatite.

An electrically conductive material layer or lower plate 142 is supported by a portion of the support member 140, to the right as viewed in FIGS. 3–4. Another electrically conductive material layer or upper plate 144 is supported by another portion of the support member 140, to the left as viewed in FIGS. 3–4. The material layers 142 and 144 are spaced apart from each other. The material layers 142 and 144 may be formed by either thin or thick film fabrication techniques. The material layers 142, 144 are made from a thin metal film, such as copper or aluminum. The material layers 142, 144 may be plated with additional materials to impart properties of chemical stability, corrosion resistance, and other desired characteristics.

A portion 146 of the material layer 144 overlies a portion 148 of the material layer 142, at a central location on the ignition element 106, as viewed in FIGS. 3–4. The overlying portions 146, 148 of the material layers 142, 144 are spaced apart by a distance S (FIG. 4) measured in a direction normal to a major side surface of the support member 140. The distance S is less than 0.2 times the square root of an area on the material layer 144 which overlaps the material layer 142. The distance S is no greater than about 0.000006 m (6 $\mu$m), and is preferably about 0.000005 m (5 $\mu$m). The material layers 142, 144 adhere to the support member 140 so they do not move relative to the support member. The material layers 142, 144 do not contact each other.

An electrical contact 162 is attached to an end of the support member 140, to the right as viewed in FIGS. 3–4, and engages the material layer 142. The contact 162 conducts electrical energy between the wire conductor lead 104 and the material layer 142. Another electrical contact 164 is attached to another end of the support member 140, to the left as viewed in FIGS. 3–4, and engages the material layer 144. The contact 164 conducts electrical energy between the wire conductor lead 102 and the material layer 144.

The electrically lossy dielectric material 180 is disposed in the space between the overlying portions 146, 148 of the respective material layers 142, 144. The dielectric material 180 may be a ferroelectric ceramic or organic compound. The two overlapping layers 142 and 144 and the intervening dielectric material 180 form an electrical capacitor. The dielectric material 180 has a relatively high dielectric constant and a non-negligible loss tangent.

The dielectric material 180 contains a lossy filler which may be a perovskite structured ferroelectric material. The perovskite structured ferroelectric material may be selected from a group including barium titanate ($BaTiO_3$), potassium niobate ($KNbO_3$), sodium nitrite ($NaNO_2$) and lithium trihydrogen selenite ($LiH_3(SeO_3)_2$). The dielectric material 180 has a dielectric constant in the range of about 300,000 to about 500,000. The dielectric material has dielectric loss tangent of less than 0.3.

The dielectric material 180 is formed by mixing a lossy filler with ceramic media in a carrier liquid with a forming agent and fatty acid dispersant. The resulting mixture is dried. The dried mixture is made at elevated temperature into desired shapes or "preforms". The preforms are substantially free of voids.

The portion of the dielectric material 180 located between the overlying portions 146, 148 of the material layers 142, 144 heats the ignition charge 86 upon the application of a high frequency alternating electric field to the dielectric material. The frequency of the alternating electric field applied to the dielectric material 180 is in the range of about 900 Khz to about 1 MHz. The frequency of the alternating electric field applied to the dielectric material 180 is preferably greater than 550,000 cycles per second (550 Khz). It is contemplated that a frequency of about 980 Khz may be preferred.

A well known dielectric heating phenomenon causes the dielectric material 180 to rapidly heat up when a high frequency alternating polarity electric field is applied. Molecules in the dielectric material 180 have a dipolar characteristic which repeatedly reverses with changes in the polarity of the electrical energy applied to the dielectric material. This rapid changing of polarity of the molecules in the dielectric material 180 causes internal friction which creates heat. Thus, the application of a high frequency alternating electric field to the dielectric material 180 results in the dissipation of part of the electrical energy of the high frequency alternating electric field as heat in the dielectric material 180. This dielectric heating action provides heat to ignite the ignition charge 86 in place of known ohmic heating of a resistive bridge wire by a direct current.

The heat generated in the dielectric material 180 is conducted through the electrically conductive layer 144 to the ignition charge 86. The heat is conducted at a rate of more than 2.0 times $10^7$ watts per square meter. The heat causes ignition of the pyrotechnic ignition charge 86.

The electrical performance of the ignition element 106 is governed by the following design parameters:

(1) Nominal operating frequency, f, of the power source 126 (FIG. 1).

(2) Dielectric constant, $K_c$, of the dielectric material 180. The dielectric constant $K_c$ is a function of frequency f.

(3) Dielectric loss tangent, tan $\delta_c$. When a high frequency alternating electric field is applied to the dielectric material 180, a loss occurs because of dissipation of part of the electrical energy as heat. In vector notation, the angle $\delta_c$, between the vector for the amplitude of the charging current and the vector for the amplitude of the total current, is the loss angle. The tangent of the loss angle $\delta_c$ times the charging current is equal to the loss current.

(4) Inter-plate common surface area, a. The inter-plate common surface area, a, is the same as the area on the electrically conductive layer 144 which overlaps the electrically conductive layer 142.

(5) Inter-plate spacing, X. The inter-plate spacing, X, corresponds to the distance designated S in FIG. 4, that is, the distance between the overlying portions 146, 148 of the material layers 142, 144

From the five design parameters set forth above, the following performance characteristics of the ignition element 106 at the operating frequency of the power source 126 may be calculated:

(1) capacitance, $C=K_c\cdot\epsilon_o\cdot a/x$, where $\epsilon_o=8.8542\cdot10^{-12}$ F/M is the permittivity of free space;

(2) reactance, $X_c=1/(\omega\cdot C)$, where $\omega=2\pi f$ is the operating frequency in radians/second;

(3) AC resistance, $R_c=[\tan\delta_c]/(\omega\cdot C)=x\cdot[\tan\delta_c]/(\omega\cdot K_c\cdot\epsilon_o\cdot a)$; and (4) impedance, $Z_c=R_c-jX_c$.

The performance characteristics of the electrical activation circuit 120 (FIG. 1) interact with the performance characteristics of the ignition element 106. The performance characteristics of the electrical activation circuit include:

source voltage (RMS), V; and source impedance, $Z_F=R_F+jX_F$.

Assuming that the electrical activation circuit 120 is inductive ($X_F>0$), the system then exhibits a resonant frequency, $f_o=[2\cdot\pi\cdot X_F\cdot C]^{-1}$. If the inductance is selected such that $X_F\approx X_C$, then the power source 126 will deliver an alternating polarity sinusoidal signal to the ignition element 106 that dissipates power in accordance with the following relationship:

$$P=V^2\cdot R_c/(R_F+R_C)^2.$$

Since the ignition element 106 is essentially two dimensional, the thermal flux will be normal to the upper and lower sides of the dielectric material 180. A fraction, h, of the heat will be emitted from the electrically conductive layer 144 to the ignition charge 86. The remainder of the heat, (1−h), dissipating into the substrate or support member 140. Thus, the thermal flux density of the top plate 144, at the surface in contact with the pyrotechnic charge, is $$\phi=h\cdot P/a,$$

$$=h\cdot V^2\cdot R_C/[a\cdot(R_F+R_C)^2]\cdot$$

The analysis is simplified if the electrical activation circuit 120 is roughly conjugate impedance matched to the ignition element 106. In this case, $Z_F\approx[Z_c]$ so that the condition, $R_F=R_C\equiv R$, is satisfied. Under this circumstance, $\phi=h\cdot V^2/(4\cdot a\cdot R)$. For the design to be practicable, the quality factor $$\Omega=X_C/R,$$

$$=1/(\omega\cdot C\cdot R),$$

$$=X/(K_c\cdot\epsilon_o\cdot a\cdot R\cdot\omega),$$

must be low, typically less than 10. If the qualify factor is too high, the initiator assembly 20 will be too sharply tuned and sensitive to mismatch between the electrical activation circuit 120 and the ignition element 106.

It is believed that a practical initiator assembly 20 and electrical activation circuit 120 is subject to the following requirements for design parameters and operating characteristics:

(1) An operating frequency, f<1 MHz for the power source 126.

(2) A dielectric constant, $K_c<500{,}000$ for the dielectric material 180.

(3) A dielectric loss tangent, tan $\delta_c<0.3$ for the dielectric material 180.

(4) An inter-plate spacing, $0.000005\ m<X<0.2\cdot a^{1/2}$ for the distance S between the electrically conductive layers 142 and 144.

(5) A source voltage (RMS), V=4.95 V (RMS) for the power source 126.

(6) A source resistance, $R_F=1.75$ ohms for the power source 126.

(7) A top plate thermal flux density, $\phi=2.43^7$ watts/m$^2$ for the electrically conductive layer 144 during dielectric heating of the dielectric material 180.

(8) A top plate flux fraction, h=0.2 for the electrically conductive layer 144 during dielectric heating of the dielectric material 180.

One specific design solution obtained was the following:

(1) operating frequency, f=980 Khz;

(2) dielectric constant, $K_c=491{,}000$;

(3) dielectric loss tangent, tan $\delta_c=0.17$;

(4) inter-plate spacing, X=5 $\mu$m;

(5) plate surface area, $a=2.89\cdot10^{-8}$ m$^2$;

(6) capacitance, C=15.4 nF; and (7) circuit quality factor, $\Omega=6$.

In operation, upon the occurrence of a collision during which the vehicle experiences a sudden deceleration which is at least equal to a predetermined deceleration, the sensor 122 closes the switch 124. The power source 126 in the circuit 102 delivers sinusoidal current of alternating polarity at a frequency which is greater than 550,000 cycles per second and is preferably in the range of 900 Khz to 1 MHz and more preferably about 980 Khz, to the initiator assembly 20. The electrical energy is conducted through the wire conductor leads 102, 104 to the ignition element 106. The portion of the dielectric material 180 located between the overlying portions 146, 148 of the material layers 142, 144 heats due to dissipation of electrical energy. The ignition element 106 rapidly heats at least a localized portion of the ignition charge 86.

The ignition charge 86 ignites when the ignition element 106 heats at least the localized portion of the ignition charge to the autoignition temperature of the ignition charge. The ignition charge 86 burns rapidly and, in turn, ignites the output charge 88. The output charge 88 produces initiating combustion products including heat, gas and hot particles. The heat of the combustion products could pressurize inert gas or ignite a combustible fuel gas, for example. Alternatively, the hot particles could ignite gas generating wafers to produce gas for inflating the air bag or ignite a quantity of pyrotechnic material to heat and pressurize an inert gas.

The ignition element 106 performs the dual functions of: (1) igniting the ignition charge 86 in response to the electrical activation circuit 120 and (2) preventing unintended igniting of the ignition charge due to accidental shorting of the electrical activation circuit. The electrically conductive layers 142 and 144 cooperate with the dielectric material 180 to form a capacitor. If the conductor leads 102 and 104 should accidently be connected with ground and a direct current power source, the dielectric material 180 will not conduct the direct electrical current. In addition, the direct current power source will be ineffective to cause dielectric heating of the dielectric material 180.

In the illustrated embodiment of the initiator assembly 20, the ignition element 106 is disposed in direct engagement with the pyrotechnic material of the ignition charge 86. It is contemplated that the pyrotechnic material could be packaged if desired. However, the packaging could tend to interfere with the transfer of heat from the ignition element 106 to the pyrotechnic material of the ignition charge 86.

In the illustrated embodiment of the initiator assembly 20, the electrically conductive layers 142 and 144 are thin films which are supported by the support member 140. It is contemplated that the dielectric material 180 and the two conductive layers 142 and 144 could be positioned in or closely adjacent to the pyrotechnic material of the ignition charge 86. This would promote heat transfer from both electrically conductive layers 142 and 144 to the pyrotechnic material of the ignition charge 86 upon dielectric heating of the dielectric material 180.

From the above description of the invention, those skilled in the art will perceive improvements, changes and modifications. Although the inflatable occupant protection device is described above as an air bag, it could also be an inflatable seat belt, an inflatable head liner, or a knee bolster which is actuated by an air bag. It should be understood that the initiator assembly 20 may be used in conjunction with apparatus other than vehicle safety apparatus. Such improvements, changes and modifications within the skill of the art are intended to be covered by the appended claims.

Having described the invention, the following is claimed:

1. An apparatus comprising:

a body of pyrotechnic material;

an initiator disposed adjacent to said body of pyrotechnic material, said initiator including a body of dielectric material; and circuit means for applying a high frequency alternating electric field to said body of dielectric material to heat by dielectric heating said body of dielectric material to a temperature sufficient to effect ignition of said body of pyrotechnic material under the influence of heat transferred from said body of dielectric material to said body of pyrotechnic material.

2. An apparatus as set forth in claim 1 wherein said body of dielectric material is effective to dissipate a portion of electrical energy in the high frequency alternating electric field as heat which is conducted to said body of pyrotechnic material.

3. An apparatus as set forth in claim 1 wherein said initiator includes a first electrically conductive layer of material and a second layer of electrically conductive material which is spaced from said first layer of electrically conductive material, said body of dielectric conductive material which are at least partially disposed in an overlapping relationship on opposite sides of said body of dielectric material, said first and second layers of electrically conductive material being spaced apart by a distance which is less than 0.2 times the square root of an area on said first layer of electrically conductive material which is overlapped by said second layer of electrically conductive material, said first and second layers of electrically conductive material being connected with said circuit means.

4. An apparatus as set forth in claim 1 wherein said initiator includes first and second spaced apart layers of electrically conductive material which are disposed on opposite sides of said body of dielectric material and are connected with said circuit means, said first layer of electrically conductive material being disposed adjacent to said body of pyrotechnic material and having a thermal energy transfer rate of more than 2.0 times $10^7$ watts per square meter during at least a portion of the application of a high frequency alternating electric field to said body of dielectric material by said circuit means.

5. An apparatus for heating temperature sensitive ignitable material, said apparatus comprising:

a body of pyrotechnic material;

an electrically conductive first material layer;

an electrically conductive second material layer having a portion spaced from and overlying a portion of said first material layer, at least one of said first and second material layers being disposed adjacent to said body of pyrotechnic material; and a dielectric material disposed between said overlying portions of said first and second material layers, the temperature of said dielectric material increasing to ignite said body of pyrotechnic material in response to dielectric heating through the application of a high frequency alternating electric field to said first and second material layers.

6. An apparatus for initiating the flow of inflation fluid from an inflator for inflating an inflatable vehicle occupant protection device, said apparatus comprising:

a housing defining a chamber and including a pair of electrical conductors electrically insulated from one another and said housing;

first ignitable material in the chamber for producing, upon ignition, combustion products which effect the flow of inflation fluid from the inflator;

second ignitable material in the chamber adjacent said first ignitable material, said second ignitable material being temperature sensitive, said second ignitable material igniting upon the temperature of at least a portion of said second ignitable material increasing to a predetermined temperature and thereby igniting said first ignitable material; and means for increasing the temperature of said second ignitable material to the predetermined temperature in response to electrical energization, said temperature increasing means contacting said second ignitable material, said temperature increasing means comprising:

an electrically conductive first material layer;

an electrically conductive second material layer having a portion spaced from and overlying a portion of said first material layer;

first conducting means for conducting electrical energy between one of said conductors and said first material layer;

second conducting means for conducting electrical energy between the other of said conductors and said second material layer; and a dielectric material disposed in the space between said overlying portions of said first and second material layers, said dielectric material heating said portion of said second ignitable material to the predetermined temperature upon the application of a high frequency alternating electric field to said dielectric material.

7. The apparatus of claim 6 wherein said dielectric material comprises a perovskite structured ferroelectric material.

8. The apparatus of claim 6 wherein said frequency alternating electric field has a frequency in the range of about 900 Khz to about 1 Mhz.

9. The apparatus of claim 6 wherein said overlying portions of said first and second material layers are spaced apart a distance no greater than about 0.000006 m (6 $\mu$m).

10. The apparatus of claim 6 wherein said dielectric material has a dielectric constant in the range of about 300,000 to about 500,000.

11. The apparatus of claim 6 wherein said temperature increasing means includes an electrically insulating member formed of a ceramic material, said first material layer being disposed on a portion of said member, said second material layer being disposed on another portion of said member.

12. An apparatus comprising:

a body of pyrotechnic material;

an initiator disposed adjacent to said body of pyrotechnic material, said initiator including a body of dielectric material, with said body of dielectric material being ineffective to conduct direct current to prevent ignition of said body of pyrotechnic material upon application of direct current to said body of dielectric material; and circuit means for applying a high frequency alternating electric field to said body of dielectric material to heat said body of dielectric material to a temperature sufficient to effect ignition of said body of pyrotechnic material under the influence of heat transferred from said body of dielectric material to said body of pyrotechnic material.

13. An apparatus comprising:

a body of pyrotechnic material;

an initiator disposed adjacent to said body of pyrotechnic material, said initiator including a body of dielectric material, said body of dielectric material having a dielectric constant which is between about 300,000 and about 500,000 and a dielectric loss tangent of less than about 0.3; and circuit means for applying a high frequency alternating electric field to said body of dielectric material to heat said body of dielectric material to a temperature sufficient to effect ignition of said body of pyrotechnic material under the influence of heat transferred from said body of dielectric material to said body of pyrotechnic material.

14. An apparatus comprising:

a body of pyrotechnic material;

an initiator disposed adjacent to said body of pyrotechnic material, said initiator including a body of dielectric material, said body of dielectric material including a ferroelectric ceramic; and circuit means for applying a high frequency alternating electric field to said body of dielectric material to heat said body of dielectric material to a temperature sufficient to effect ignition of said body of pyrotechnic material under the influence of heat transferred from said body of dielectric material to said body of pyrotechnic material.

15. An apparatus comprising:

a body of pyrotechnic material;

an initiator disposed adjacent to said body of pyrotechnic material, said initiator including a body of dielectric material and first and second layers of electrically conductive material, said first and second layers of electrically conductive material being at least partially disposed in an overlapping relationship on opposite sides of said body of dielectric material and being spaced apart by a distance which is less than about 0.2 times the square root of an area on said first layer of electrically conductive material which is overlapped by said second layer of electrically conductive material, and circuit means for applying a high frequency alternating electric field to said body of dielectric material to heat said body of dielectric material to a temperature sufficient to effect ignition of said body of pyrotechnic material under the influence of heat transferred from said body of dielectric material to said body of pyrotechnic material, and said first and second layers of electrically conductive material being connected with said circuit means.

16. An apparatus comprising:

a body of pyrotechnic material;

an initiator disposed adjacent to said body of pyrotechnic material, said initiator including a body of dielectric material, and circuit means for applying a high frequency alternating electric field to said body of dielectric material to heat said body of dielectric material to a temperature sufficient to effect ignition of said body of pyrotechnic material under the influence of heat transferred from said body of dielectric material to said body of pyrotechnic material, wherein said circuit means is operable to apply an alternating electric field having a frequency of more than about 550,000 cycles per second to said body of dielectric material, said body of dielectric material having a dielectric constant of more than about 300,000.

17. An apparatus comprising:

a body of pyrotechnic material;

an initiator disposed adjacent to said body of pyrotechnic material, said initiator including a body of dielectric material comprising a perovskite structured ferroelectric material; and circuit means for applying a high frequency alternating electric field to said body of dielectric material to heat said body of dielectric material to a temperature sufficient to effect ignition of said body of pyrotechnic material under the influence of heat transferred from said body of dielectric material to said body of pyrotechnic material.

18. An apparatus as set forth in claim 17 wherein said perovskite structured ferroelectric material is selected from a group comprising barium titanate ($BaTiO_3$), potassium niobate ($KNbO_3$), sodium nitrite ($NaNO_2$), and lithium trihydrogen selenite ($LiH_3(SeO_3)_2$).

19. An apparatus for heating temperature sensitive ignitable material, said apparatus comprising:

a body of pyrotechnic material;

an electrically conductive first material layer;

an electrically conductive second material layer having a portion spaced from and overlying a portion of said first material layer, at least one of said first and second material layers being disposed adjacent to said body of pyrotechnic material; and a dielectric material disposed between said overlying portions of said first and second material layers, the temperature of said dielectric material increasing to ignite said body of pyrotechnic material in response to the application of a high frequency alternating electric field to said first and second material layers, wherein said dielectric material comprises a perovskite structured ferroelectric material.

20. The apparatus of claim 19 wherein said perovskite structured ferroelectric material is selected from a group comprising barium titanate ($BaTiO_3$), potassium niobate ($KNbO_3$), sodium nitrite ($NaNO_2$) and lithium trihydrogen selenite ($LiH_3(SeO_3)_2$).

21. An apparatus for heating temperature sensitive ignitable material, said apparatus comprising:

a body of pyrotechnic material;

an electrically conductive first material layer;

an electrically conductive second material layer having a portion spaced from and overlying a portion of said first material layer, at least one of said first and second material layers being disposed adjacent to said body of pyrotechnic material;

a dielectric material disposed between said overlying portions of said first and second material layers, the temperature of said dielectric material increasing to ignite said body of pyrotechnic material in response to the application of a high frequency alternating electric field to said first and second material layers; and an electrically insulating member which supports said first and second material layers.

22. An apparatus for heating temperature sensitive ignitable material, said apparatus comprising:

a body of pyrotechnic material;

an electrically conductive first material layer;

an electrically conductive second material layer having a portion spaced from and overlying a portion of said first material layer, at least one of said first and second material layers being disposed adjacent to said body of pyrotechnic material; and a dielectric material disposed between said overlying portions of said first and second material layers, the temperature of said dielectric material increasing to ignite said body of pyrotechnic material in response to the application of a high frequency alternating electric field to said first and second material layers, said high frequency alternating electric field having a frequency in the range of about 900 kHz to about 1 MHz.

23. An apparatus for heating temperature sensitive ignitable material, said apparatus comprising:

a body of pyrotechnic material;

an electrically conductive first material layer;

an electrically conductive second material layer having a portion spaced from and overlying a portion of said first material layer, said overlying portions of said first and second material layers are spaced apart a distance no greater than about 0.000006 m (6 $\mu$m), with at least one of said first and second material layers being disposed adjacent to said body of pyrotechnic material; and a dielectric material disposed between said overlying portions of said first and second material layers, the temperature of said dielectric material increasing to ignite said body of pyrotechnic material in response to the application of a high frequency alternating electric field to said first and second material layers.

24. An apparatus for heating temperature sensitive ignitable material, said apparatus comprising:

a body of pyrotechnic material;

an electrically conductive first material layer;

an electrically conductive second material layer having a portion spaced from and overlying a portion of said first material layer, at least one of said first and second material layers being disposed adjacent to said body of pyrotechnic material; and a dielectric material disposed between said overlying portions of said first and second material layers, the temperature of said dielectric material increasing to ignite said body of pyrotechnic material in response to the application of a high frequency alternating electric field to said first and second material layers, with said dielectric material having a dielectric constant in the range of about 300,000 to about 500,000.

* * * * *

UNITED STATES PATENT AND TRADEMARK OFFICE

CERTIFICATE OF CORRECTION

PATENT NO. : 5,845,578
DATED : December 8, 1998
INVENTOR(S) : Homer W. Fogle, Jr.

It is certified that error appears in the above-identified patent and that said Letters Patent is hereby corrected as shown below:

Column 9,
Line 27, after "dielectric" delete "conductive material which are at least partially disposed in an overlapping relationship on opposite sides of said body of dielectric material, said first and second layers of electrically conductive material being spaced apart by a distance which is less than 0.2 times the square root of an area on said first layer of electrically conductive material which is overlapped by said second layers of electrically conductive material being connected with said circuit means."

Column 9,
Line 27, after "dielectric" insert -- material having a first side which is disposed in engagement with said first layer of electrically conductive material and a second side which is disposed in engagement with said second layer of electrically conductive material, said first and second layers of electrically conductive material being connected with said circuit means to enable the high frequency alternating electric field to be established across said body of dielectric material by said circuit means. --

Signed and Sealed this

Seventh Day of August, 2001

*Attest:*

Nicholas P. Godici

*Attesting Officer*

NICHOLAS P. GODICI
*Acting Director of the United States Patent and Trademark Office*